US005335680A

United States Patent [19]

Moore

[11] Patent Number: 5,335,680

[45] Date of Patent: Aug. 9, 1994

[54] HAIR CLIP

[76] Inventor: Pamela K. Moore, 145 Bayou Bend Dr., League City, Tex. 77573

[21] Appl. No.: 51,848

[22] Filed: Apr. 26, 1993

[51] Int. Cl.[5] ..... A45D 8/00

[52] U.S. Cl. ..... 132/276; 132/132; 132/133

[58] Field of Search ..... 132/128, 129, 130, 131, 132/132, 133, 134, 135, 138, 146, 273, 276, 279

[56] References Cited

U.S. PATENT DOCUMENTS

| | | | |
|---|---|---|---|
| Re. 5,348 | 4/1873 | Noyes | 132/146 |
| 95,130 | 9/1869 | Noyes | 132/130 |
| 161,661 | 4/1875 | Brown | 132/132 |
| 1,596,737 | 8/1926 | Johnson | 132/133 |
| 2,159,709 | 5/1939 | Quetin | 132/133 |
| 2,569,659 | 10/1951 | Dombeek | 132/133 |
| 3,998,233 | 12/1976 | Dorr | 132/279 |

*Primary Examiner*—Gene Mancene
*Assistant Examiner*—Frank A. LaViola

[57] ABSTRACT

A hair clip including a first comb member having a forward end and a rearward end and a plurality of teeth extending therefrom, a first comb member having a forward end and a rearward end with a plurality of teeth extending therefrom, and a flexible band affixed to the rearward end of the first comb member and affixed to the rearward end of the second comb member. The flexible band has an accordion shape of expandable length. The forward end of the first comb member is detachably connected to a forward end of the second comb member such that the teeth are separated in an unintertwined relationship. The first comb member is movable between a first position engaging the forward end of the second comb member and a first position extending distal the second comb member.

9 Claims, 2 Drawing Sheets

HAIR CLIP

TECHNICAL FIELD

The present invention relates to hair dressing apparatus. More particularly, the present invention relates to hair clips for holding and retaining locks of hair.

BACKGROUND ART

During hair dressing and preparation activities, a variety of hair dressing implements are employed for the purpose of maintaining the style and appearance of a person's hair. Often, combs are employed so as to untangle the hair and to provide the hair with a smooth and neat appearance. Often, it is desired to group locks of hair together so as to achieve a particular style. For example, pony tails are often quite popular, not only for the ease in which it may be cared for, but also for the comfort that it affords in keeping the hair away from the neck in hot weather. Ordinarily, however, as soon as the ponytail is formed, there is a tendency for it to droop so that the hair does come into contact with the back of the neck, thus detracting from the comfort to the individual. There are various other hair styles in which several locks of hair join together for the purpose of fashion. Ordinarily, hair clips are employed, in various styles and designs, so as to secure these locks of hair together.

One type of hair clip that has been used in the past is known as a "clincher comb". An example of such a clincher comb is shown by U.S. Pat. No. 3,998,233. This hair clip has a fastener on one end and an interlocking pivoting lock on the other end. Unfortunately, the pivot often becomes tangled in the hair at the nape of the neck. Another type of comb is known as the "stretch comb". This stretch comb has long teeth that, when closed, cross and interlock on top of each other. The points of the teeth of the comb have a tendency to press into the scalp. Although this device does hold the hair very well, it also puts pressure on the hair on the back of the head which is very uncomfortable. In those instances where the teeth of such a stretch comb can be reversed, the hair is pulled away from the scalp, also in an uncomfortable manner. A third type of conventional hair clip is known as a "nylon flexible comb". This is an expandable band that has a loop. The last tooth of the comb is inserted into the loop so as to fasten it. When the nylon flexible comb is used, the closure is at the crown of the head. Although this clip has versatility, it does not stay in place. Once it is stretched to the desired style, it tends to crawl back into its original shape.

Throughout the years, a number of patents have issued on various types of hair clips and hair retaining combs. For example, U.S. Pat. No. 622,568, issued on Apr. 4, 1899, describes a lady's hair retaining comb. This device employs three pivotally connected members. Each of the members are provided with comb-teeth for passing into the hair. This device also utilizes outwardly and forwardly projecting flanges, wings, or blades, on which the hair may be arranged and supported in knots. U.S. Pat. No. 918,203, issued on Apr. 13, 1909, to I. M. Schwarzer describes another type of retaining comb having two members which are curved toward each other and are pivotally connected with each other at a pivot point. The pivot point allows each of the members to swing into an open and into a closed end. The free ends of these members are provided with lugs which are adapted to interlock when the members are in a closed position. The members are placed on the back of the head so that the hair braid is passed between each of the members. The members are then closed with the hair locked between the overlapping teeth. A braid is then wound around the device so as to engage the outermost teeth such that the device is almost completely covered with the hair. U.S. Pat. No. 1,596,737, issued on Aug. 17, 1926, to H. W. Johnson shows a hair waving device. This device employs a pair of combs which are curved in the direction of their length to approximate the curvature of the head. These combs are connected at one end by a pivot or hinge so as to allow partial rotary movement of either comb relative to the other comb. The combs are disposed and connected in such a manner that when closed, the teeth of one comb rests in an intertwined relationship in the spaces between the teeth of the other comb. When the two combs interengage in their closed position, a wave or ridge of hair is formed above and between them. The combs are left in this position until the hair is dry. When the comb is removed, it leaves a wave in the hair at the position in which it is occupied. U.S. Pat. No. 2,902,042, issued on Sep. 1, 1959, to J. Halber discloses another type of hair-retaining comb. This device employs a main comb which is adapted to be placed in supported engagement with the hair adjacent to the scalp on the back of the neck of the wearer. A pair of comb elements, each provided with a plurality of widely spaced apart teeth, is in hinged connection about a single point on the body of the main comb. Hook portions are provided on the opposite end of the comb element so as to releasably interlock with each other to secure the comb elements in their normally closed position. U.S. Pat. No. 2,159,709, issued on May 23, 1939, to G. A. Quetin shows a hair clasp which has a first body member and a second body member hingedly connected together. A pair of jaws extending from the body members are interconnected so as to serve as a locking clasp. The teeth extend toward each other in generally linear alignment. U.S. Pat. No. 2,569,659, issued on Oct. 2, 1951, to B. M. Dombek describes a comb hair lock which has a pair of large comb portions which are pivotally connected to small comb portions, which are in turn pivotally connected together. In this manner, each of the comb portions is hingedly connected together so as to form a variety of particular configurations. U.S. Pat. No. 2,718,894, issued on Sep. 27, 1955 discloses a ring comb having a pair of body members which are hingedly connected at one end and have a connecting mechanism formed at the opposite end. Each of the body members has a semi-circular configuration. A plurality of teeth extend outwardly from each of the body members toward the other body member. The teeth are generally intertwined within the circular area formed when the body members are locked together. Hair is retained within the ring comb and is intertwined with the teeth of the comb.

It is an object of the present invention to provide a hair clip that eliminates the pivoting hinge.

It is another object of the present invention to provide a hair clip that is comfortable and adaptable to various hair lengths and uses.

It is another object of the present invention to provide a hair clip that stays in place better than prior hair clips.

It is still a further object of the present invention to provide a hair clip that is relatively easy to use, simple to manufacture, and relatively inexpensive.

These and other objects and advantages of the present invention will become apparent from a reading of the attached specification and appended claims.

SUMMARY OF THE INVENTION

The present invention is a hair clip that comprises a first comb member having a forward end and a rearward end with a plurality of teeth extending therefrom, a second comb member having a forward end and a rearward end with a plurality of teeth extending therefrom and a flexible band affixed to the rearward end of the first comb member and affixed to the rearward end of the second comb member. The forward end of the first comb member is detachably connected to the forward end of the second comb member such that the teeth are separated in an unintertwined relationship. The flexible band has an expandable length.

The first comb member includes a rigid bar which extends from the forward end to the rearward end. The plurality of teeth extend toward the second comb member from the rigid bar of the first comb member. Similarly, the second comb member includes a rigid member which extends from the forward end to the rearward end. The plurality of teeth of the second comb member extend toward the teeth of the first comb member.

The flexible band has an accordion-shape which extends outwardly from the rearward end of the first comb member and the rearward end of the second comb member. The flexible band serves to form an expandable loop between the first and second comb members.

The first comb member is movable between a first position engaging the forward end of the second comb member and a second position in which the first comb member extends distal the second comb member. In the first position, the first comb member extends at an acute angle from the forward end of the second comb member. The teeth of the first comb member have end points which are colinearly aligned at a corresponding angle.

In one embodiment of the present invention, the forward end of the first comb member has a pin formed thereon. The forward end of the second comb member has a receptacle formed thereon. The pin is engagable with the receptacle so as to detachably connect the first comb member to the second comb member. Alternatively, the forward end of the first comb member has a first hook formed thereon. The forward end of the second comb member will have a second hook formed thereon. These first and second hooks are interengagable so as to join the forward ends of the comb members.

DETAILED DESCRIPTION OF THE INVENTION

Figure 1:
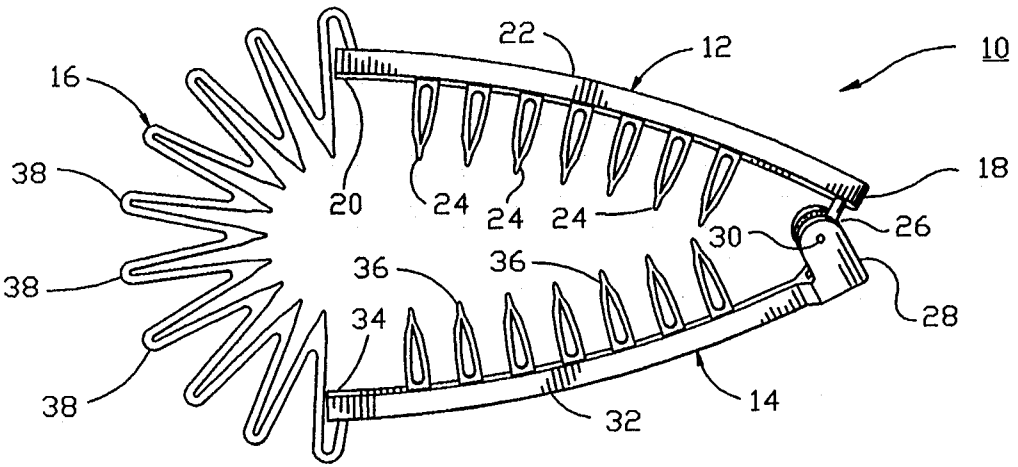
FIG. 1 is a side elevational view of the hair clip of the present invention, as shown in its closed position.

Referring to FIG. 1, there is shown at 10 the hair clip in accordance with the preferred embodiment of the present invention. Hair clip 10 comprises a first comb member 12, a second comb member 14, and a flexible band 16. First comb member 12 has a forward end 18 and a rearward end 20. A rigid bar 22 extends between the forward end 18 and the rearward end 20. A plurality of teeth 24 extend outwardly from the rigid bar 22 toward the second comb member 14. Typically, the first comb member 12 is made of a rigid plastic material. The forward end 18 is detachably connected at 26 to the forward end 28 of the second comb member 14. As illustrated in FIG. 1, the forward end 18 of the first comb member 12 has a pin extending downwardly therefrom. The pin engages a receptacle 30 formed on the forward end 28 of the second comb member 14. The rigid bar extends from the forward end 18 to the rearward end 20.

The second comb member 14 includes a rigid member 32 which extends from the forward end 28 to the rearward end 34. A plurality of teeth $6 extend upwardly from the rigid bar 32 toward the first comb member 12. The flexible band 16 is affixed to the rearward end $4 of the second comb member 14.

As can be seen in FIG. 1, the first comb member 12 is detachably connected at 26 to the second comb member 14. As such, the first comb member 12 extends at an acute angle relative to the second comb member 14. Each of the teeth 24 has aligned ends which are colinear and extend at a similar angle with respect to the second comb member 14. As can be seen in FIG. 1, when the first comb member 12 is connected to the second comb member 14, the teeth 24 are separated from the teeth 36. It can also be seen that the teeth 24 are in an unintertwined relationship with respect to the teeth 36. As such, the space in the area between the inside surface of the first rigid bar 22 and the inside surface of the rigid member 32 serves as a hair receiving area.

The flexible band 16 has one end connected to the rearward end 20 of the first comb member 12. The flexible band 16 also has another end connected to the rearward end 34 of the second comb member 14. The flexible band 16 generally forms a loop between the ends 20 and 34 of the first comb member 12 and the second comb member 14, respectively. The flexible band 16 is made of a plastic material that is of an expandable length. In order to achieve this effect, the flexible band 16 is accordion shaped. Specifically, this accordion shape comprises a plurality of V-shaped members 38 that are interconnected to each other in the form of a loop.

Figure 2:
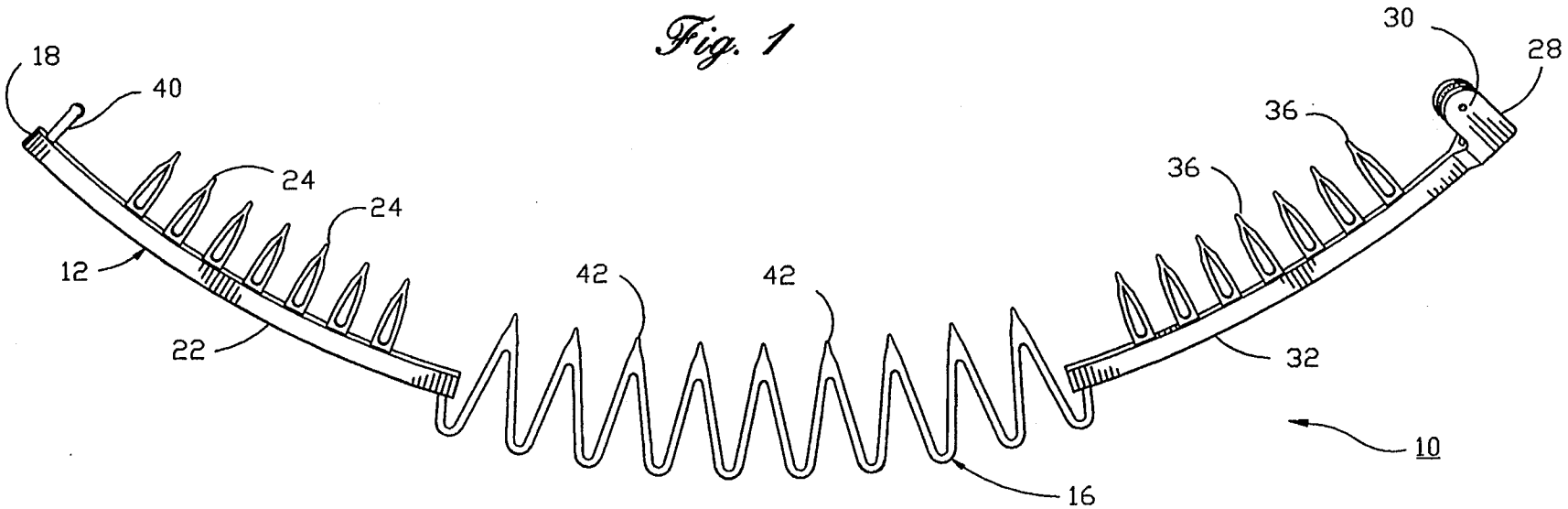
FIG. 2 is a side elevational view of the hair clip of the present invention, as shown in its open position.

FIG. 2 illustrates the hair clip 10 of the present invention in which the forward end 18 of the first comb member 12 is separated from the forward end 28 of the second comb member 14. In particular, it can be seen that a pin 40 extends inwardly from the end 18. Similarly, the receptacle 30 extends upwardly from the forward end 28 of the second comb member 14. When the pin 40 is inserted into the receptacle 30, then the connected arrangement of hair clip 10 is provided, as shown in FIG. 1.

The arrangement of FIG. 2 shows the hair clip 10 in its open position suitable for attachment to the hair. The teeth 36 of the second comb member 10 extend upwardly from the rigid member 32. Similarly, the teeth 24 of the first comb member 12 extend upwardly from the rigid bar 22. The flexible band 16 is shown as slightly expanded so as to accommodate the receipt of hair therebetween. It can be seen that the flexible band 16 has inner end points 42 which extend inwardly in the same manner as the teeth 36. When the end 18 of the first comb member 12 is pulled outwardly relative to the second comb member 14, then the flexible band 16 will expand outwardly so as to increase the distance between the comb members 12 and 14.

As can be seen, the hair clip 10 achieves advantages not found in previous hair clip configurations. Since the hair clip 10 of the present invention eliminates the pivoting hinge, there is an elimination of the tangles associated therewith. It is often uncomfortable and painful when the hair becomes tangled with the pivoting hinge of a conventional hair clip. The present invention is very comfortable and, because of the flexible band, can be made in any length to accommodate different hair lengths and uses. It has been found that the use of the flexible band 16 between the first comb member 12 and the second comb member 14 actually makes the clip more comfortable than previous clips and causes the clip to stay in place in a better and more reliable fashion. Since the hair clip 10 of the present invention is open at the end that connects to the flexible band, the hair clip 10 no longer bites into the scalp at each end. The hair clip 10 of the present invention is gentle to the hair and it will still hold, without the necessity to pull the hair so tight that the hair is broken or the style is ruined. The hair clip 10 of the present invention allows a person to pull their hair into a real pony tail or just pull it into a more bouffant style where the hair is held in place loosely, without slippage.

Figure 3:
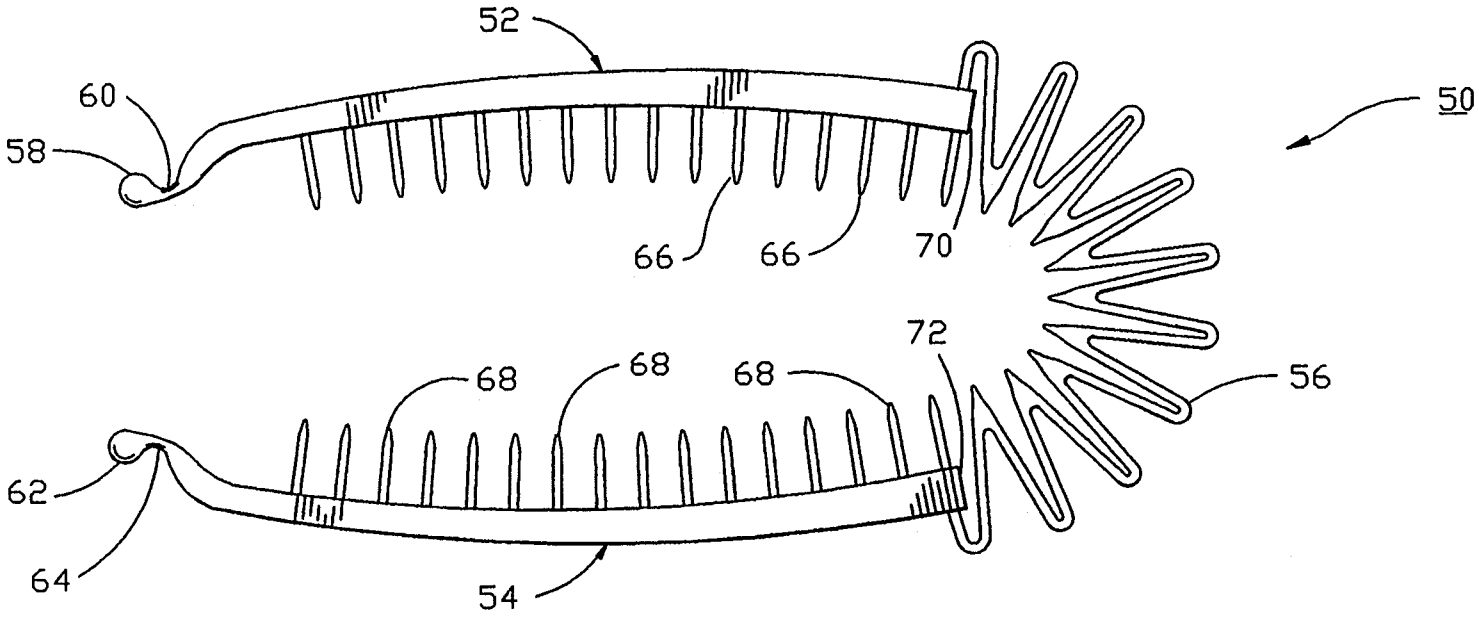
FIG. 3 is a side elevational view showing an alternative embodiment of the hair clip of the present invention.

FIG. 3 shows an alternative embodiment of the present invention. In particular, in FIG. 3, it can be seen that the hair clip 50 includes a first comb member 52, a second comb member 54, and a flexible band 56. A first comb member 52 and a second comb member 54 have a configuration somewhat similar to that of the previous embodiment, described in conjunction with FIGS. 1 and 2. The first comb member 52 has a forward end 58 which has a hook portion 60 formed thereon. Similarly, the second comb member 54 has a forward end 62 which has a complementary hook portion 64 formed thereon. The teeth 66 extend from the first comb member 52 toward the second comb member 54. Similarly, the first comb member 54 has teeth 68 which extend toward the first comb member 52. The flexible band 56 has a configuration similar to that of the previous embodiment. The flexible band 56 connects to the rearward end 70 of the first comb member 52 and the rearward end 72 of the second comb member 54.

In use, the hair clip 50 of the alternative embodiment of the present invention is Joined together by interconnecting the hook portions 60 and 64 of the first comb member 52 and the second comb member 54, respectively. This will cause the ends to be joined together such that the body of the first comb member 52 extends at an acute angle relative to the first comb member 54. The teeth 66 and 68 will remain separated in unintertwined relationship.

This embodiment of the present invention, through the use of the expandable band, gives the user more flexibility to comb the hair upwardly, around, downwardly, or straight back into a style. The comb members 52 and 54 have flat base sides. This embodiment of the invention also prevents the hair from being tangled in the hinges. The combination of the expandable band 56 and the comb members 52 and 54 holds the hair in place better and is much more comfortable than conventional hair clip configurations.

The foregoing disclosure and description of the invention is illustrative and explanatory thereof. Various changes in the details of the illustrated invention may be made within the scope of the appended claims without departing from the true spirit of the invention. The present invention should only be limited by the following claims and their legal equivalents.

I claim:

1. A hair clip comprising:

a first comb member having a forward end and a rearward end;

a second comb member having a forward end and a rearward end, said first comb member and said second comb member having a plurality of teeth extending therefrom; and a flexible and stretchable accordion-shaped band extending to said rearward ends of said first and second comb members, said first and second comb members movable between a first position in which said forward ends are engaged and a second position in which said forward ends are separated, said first and second comb members movable about said band, said teeth of said first comb member directed toward said teeth of said second comb member in a separated and unintertwined relationship in said first position, said band having a portion extending inwardly of said first and second comb members, the accordion shape being a plurality of interconnected V-shaped segments which are stretchable.

2. The hair clip of claim 1, said band forming a loop extending between said rearward ends of said first and second comb members.

3. The hair clip of claim 2, said band having an expandable length between said rearward ends of said first and second comb members.

4. The hair clip of claim 1, said first comb member extending at an acute angle relative to said second comb member in said first position, said teeth extending perpendicular to said first and second comb members, said teeth forming a hair-receiving space therebetween.

5. The hair clip of claim 4, said band expandable so as to vary said acute angle between said first and second comb members in said first position.

6. The hair clip of claim 1, said forward end of said first comb member having a pin formed thereon, said forward end of said second comb member having a receptacle, said pin engagable with said receptacle.

7. The hair clip of claim 1, said forward end of said first comb member having a first hook formed thereon, said forward end of said second comb member having a second hook formed thereon, said first and second hooks being interengagable so as to join said forward ends.

8. The hair clip of claim 1, said first and second comb members being rigid members, each of said first and second comb members having rigid teeth extending outwardly therefrom.

9. The hair clip of claim 1, said first comb member extending at an acute angle from said forward end of said second comb member, said plurality of teeth of said first comb member having end points colinearly aligned at a corresponding acute angle.

* * * * *